US006545405B1

(12) United States Patent
Shino et al.

(10) Patent No.: US 6,545,405 B1
(45) Date of Patent: Apr. 8, 2003

(54) AC PLASMA DISPLAY PANEL HAVING SCANNING/SUSTAIN ELECTRODES OF PARTICULAR STRUCTURE

(75) Inventors: Taichi Shino, Nara (JP); Kazunori Hirao, Osaka (JP); Shinya Fujiwara, Kyoto (JP); Kenji Kiriyama, Hyogo (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/531,046

(22) Filed: Mar. 20, 2000

(30) Foreign Application Priority Data

Mar. 31, 1999 (JP) ..... 11-092604

(51) Int. Cl.[7] ..... H01J 1/62; H01J 63/04

(52) U.S. Cl. ..... 313/491; 313/485; 313/582; 313/583

(58) Field of Search ..... 313/491, 485, 313/489, 492, 582, 583, 584, 585, 586, 631

(56) References Cited

U.S. PATENT DOCUMENTS

| | | | | |
|---|---|---|---|---|
| 3,811,062 | A * | 5/1974 | Andoh et al. | 313/586 |
| 5,852,347 | A | 12/1998 | Marcotte | 315/169.4 |
| 5,900,694 | A | 5/1999 | Matsuzaki et al. | 313/484 |
| 6,043,605 | A * | 3/2000 | Park | 313/586 |
| 6,097,149 | A * | 8/2000 | Miyaji et al. | 313/582 |
| 6,211,614 | B1 * | 4/2001 | Katayama et al. | 313/582 |
| 6,242,864 | B1 * | 6/2001 | Nakahara et al. | 315/169.3 |
| 6,252,353 | B1 * | 6/2001 | Ha et al. | 313/582 |
| 6,266,033 | B1 * | 7/2001 | Kim | 345/66 |
| 6,281,628 | B1 * | 8/2001 | Choi et al. | 313/585 |
| 6,329,751 | B2 * | 12/2001 | Yoo | 313/582 |
| 6,411,033 | B1 * | 6/2002 | Mori et al. | 313/582 |

FOREIGN PATENT DOCUMENTS

| | | | |
|---|---|---|---|
| EP | 0 865 068 A2 | | 9/1998 |
| EP | 0865068 A2 | * | 9/1998 |
| JP | 9-251842 | | 9/1997 |
| JP | 11025864 A | * | 1/1999 |
| JP | 2001155643 A | * | 6/2001 |
| JP | 2001256893 A | * | 9/2001 |

OTHER PUBLICATIONS

Park et al. "A Four–Electrode ACPDP with High Luminance", *IDW'* 96, pp. 283–286.

* cited by examiner

*Primary Examiner*—Vip Patel
*Assistant Examiner*—Kevin Quarterman
(74) *Attorney, Agent, or Firm*—Merchant & Gould P.C.

(57) ABSTRACT

An AC plasma display panel in which variation in display luminance and occurrence of error display are suppressed is provided. A first insulating substrate and a second insulating substrate are positioned opposing each other. On the first insulating substrate, a scanning/sustain-electrode group including a plurality of sets of a scanning electrode and a sustain electrode that are arranged in parallel to each other and a dielectric layer covering the scanning/sustain-electrode group are provided. A plurality of data electrodes that are orthogonal to and opposing the scanning electrode and the sustain electrode are provided on the second insulating substrate. Discharges between the scanning electrode and the sustain electrode allow phosphors to emit light. Each of the plurality of sets includes, as a unit, the scanning electrode and the sustain electrodes positioned on both sides of the scanning electrode, and the plurality of sets are separated from one another.

2 Claims, 10 Drawing Sheets

AC PLASMA DISPLAY PANEL HAVING SCANNING/SUSTAIN ELECTRODES OF PARTICULAR STRUCTURE

FIELD OF THE INVENTION

The present invention relates to an AC plasma display panel used for image display in a television receiver, a computer monitor, or the like.

BACKGROUND OF THE INVENTION

A conventional AC plasma display panel (hereinafter referred to as a "panel") is shown in FIG. 6. On a first insulating substrate 1, a plurality of sustain electrodes 4 and a plurality of scanning electrodes 5, which are covered with a dielectric layer 2 and a protective film 3, are provided alternately in parallel. A plurality of data electrodes 7 are provided on a second insulating substrate 6. Between respective data electrodes 7, a plurality of separation walls 8 are provided in parallel to the data electrodes 7. Phosphors 9 are provided on the data electrodes 7 and side faces of the separation walls 8. The first insulating substrate 1 and the second insulating substrate 6 are positioned opposing each other so that the sustain electrodes 4 and the scanning electrodes 5 are orthogonal to the data electrodes 7. Each sustain electrode 4 includes a transparent electrode 41 and a bus-bar 42 formed on the transparent electrode 41. Similarly, each scanning electrode 5 includes a transparent electrode 51 and a bus-bar 52 formed on the transparent electrode 51.

Generally, since a transparent electrode formed of ITO (Indium Tin Oxide) or the like has a high resistance, a bus-bar formed of silver or the like is superposed on the transparent electrode, thus lowering the resistance in an electrode as a whole. Therefore, the resistances per unit length of the sustain electrode 4 and the scanning electrode 5 depend on the resistance of the bus-bars 42 and 52. Thus, the line width of the bus-bar 42 of the sustain electrode 4 and that of the bus-bar 52 of the scanning electrode 5 are made to be approximately the same, thus setting the resistance per unit length of the sustain electrode 4 and that of the scanning electrode 5 to be approximately the same. Further, on both the adjacent sides of all the scanning electrodes 5, the sustain electrodes 4 are disposed. Display is carried out by sustain discharges in two places between respective scanning electrodes 5 and sustain electrodes 4 on both the adjacent sides thereof.

As shown in FIG. 7, the electrodes in this conventional panel include M rows of scanning electrodes $SCN_1$ to $SCN_M$ and M+1 rows of sustain electrodes $SUS_1$ to $SUS_{M+1}$, which are arranged in the row direction. In the column direction, N columns of data electrodes $D_1$ to $D_N$ are arranged. The intersections of the respective data electrodes and the respective sets of scanning electrodes and sustain electrodes on both adjacent sides thereof function as discharge cells $C_{11}$ to $C_{MN}$. The discharge cells $C_{11}$ to $C_{MN}$ are arranged in a matrix form of M×N. The scanning electrodes $SCN_1$ to $SCN_M$ are connected to a driving circuit at their left ends and the sustain electrodes $SUS_1$ to $SUS_{M+1}$ are connected to the driving circuit at their right ends, which is not shown in the figure.

A method of driving this conventional panel is described using a diagram showing a timing chart of an operation driving waveform shown in FIG. 8.

Initially, in a write period, all the sustain electrodes $SUS_1$ to $SUS_{M+1}$ are maintained at a voltage of 0. In scanning of the first row by a scanning electrode $SCN_1$, a positive write pulse voltage of +Vw is applied to a designated data electrode $D_j$ (j indicates one or more integers of 1 to N) that is selected from the data electrodes $D_1$ to $D_N$ and corresponds to a discharge cell to be operated so as to emit light, and a negative scan pulse voltage of −Vs is applied to the scanning electrode $SCN_1$. This causes a write discharge in a discharge cell $C_{1j}$ at the intersection of the designated data electrode $D_j$ and the scanning electrode $SCN_1$. This write discharge induces discharges between the scanning electrode $SCN_1$ and respective half portions of the sustain electrodes $SUS_1$ and $SUS_2$ facing the scanning electrode $SCN_1$. In the discharge cell $C_{1j}$ in which the write discharges have occurred, positive electric charges are stored at the surface of the protective film 3 on the scanning electrode $SCN_1$, and negative electric charges at the surface of the protective film 3 on the respective half portions of the sustain electrodes $SUS_1$ and $SUS_2$.

Next, in scanning of the second row by a scanning electrode $SCN_2$, a positive write pulse voltage of +Vw is applied to a designated data electrode $D_j$ that is selected from the data electrodes $D_1$ to $D_N$ and corresponds to a discharge cell to be operated so as to emit light, and a negative scan pulse voltage of −Vs is applied to the scanning electrode $SCN_2$. This causes a write discharge in a discharge cell $C_{2j}$ at the intersection of the designated data electrode $D_j$ and the scanning electrode $SCN_2$. This write discharge induces discharges between the scanning electrode $SCN_2$ and respective half portions of the sustain electrodes $SUS_2$ and $SUS_3$ facing the scanning electrode $SCN_2$. In the discharge cell $C_{2j}$ in which the write discharges have occurred, positive electric charges are stored at the surface of the protective film 3 on the scanning electrode $SCN_2$, and negative electric charges at the surface of the protective film 3 on the respective half portions of the sustain electrodes $SUS_2$ and $SUS_3$.

Successively, the same scanning operation is carried out for all remaining rows up to the scanning electrode $SCN_M$ in the M row. Thus, the same predetermined electric charges as described above are stored at the surface of the protective film 3.

In the subsequent sustain period, initially a negative sustain pulse voltage of −Vm is applied to all the sustain electrodes $SUS_1$ to $SUS_{M+1}$. Thus, in a discharge cell $C_{ij}$ (i indicates one or more integers selected from 1 to M) in which the write discharges have occurred, the voltage between the surface of the protective film 3 on a scanning electrode $SCN_i$ and the surface of the protective film 3 on sustain electrodes $SUS_i$ or $SUS_{i+1}$ is the sum of the negative sustain pulse voltage of −Vm, the positive electric charges at the surface of the protective film 3 on the scanning electrode $SCN_i$, and the negative electric charges at the surface of the protective film 3 on the sustain electrodes $SUS_i$ or $SUS_{i+1}$, which exceeds the discharge starting voltage. Therefore, sustain discharges start between the scanning electrode $SCN_i$ and the sustain electrodes $SUS_i$ and $SUS_{i+1}$. As a result, the electric charges stored at the surface of the protective film 3 are reversed and thus negative electric charges are stored at the surface of the protective film 3 on the scanning electrode $SCN_i$ and positive electric charges at the surface of the protective film 3 on the sustain electrodes $SUS_i$ and $SUS_{i+1}$. Successively, the negative sustain pulse voltage of −Vm is applied to all the scanning electrodes $SCN_1$ to $SCN_M$ and all the sustain electrodes $SUS_1$ to $SUS_M$ alternately. Thus, in the discharge cell $C_{ij}$ in which the write discharges have occurred, sustain discharges occur successively between the scanning electrode $SCN_i$ and the sustain electrodes $SUS_i$ and $SUS_{i+1}$. Light emissions caused by those sustain discharges are used for display.

In the subsequent erase period, a negative narrow-width erase pulse voltage of −Ve is applied to all the sustain electrodes $SUS_1$ to $SUS_{M+1}$. This causes erase discharges to terminate the sustain discharges. With the above-mentioned operations, one picture is displayed in the panel.

In such display of one picture, only light emissions with a certain constant luminance can be used for the display. Therefore, when a gray-scale image is to be displayed as in image display for a television, the display period of one picture is set to be one subfield, and during 1/60 second, which is the duration of one field, subfields, each of which has a different luminance of light emission used for display, are repeated plural times. For example, if a reference luminance is $B_0$, by using one field consisting of eight subfields sub1, sub2, sub3, . . . , sub8 in which display luminances are $2^0 \times B_0$, $2^1 \times B_0$, $2^2 \times B_0$, . . . , $2^7 \times B_0$ respectively, a display having $2^8=256$ shades of gray can be carried out.

In the above-mentioned conventional panel, however, in the case of a partial display, the difference in luminance may occur on the right and left sides of a screen, thus causing unevenness in display luminance, which has been a problem. Furthermore, discharge cells other than those intended to emit light may be operated to emit light due to error discharges, thus causing error display, which also has been a problem. These problems are explained as follows.

FIG. 9 shows an array of the electrodes in the first to third rows shown in the electrode array diagram in FIG. 7. FIG. 9(*a*) shows a state in which sustain discharges are occurring in three discharge cells $C_{1j}$, $C_{2j}$, and $C_{3j}$ positioned in the first to third rows in the j column. FIG. 9(*b*) shows a state in which sustain discharges are occurring only in one discharge cell $C_{2j}$ positioned in the second row in the j column. In each diagram, arrows indicate discharge currents flowing in the scanning electrodes $SCN_1$, $SCN_2$and $SCN_3$ and the sustain electrodes $SUS_1$, $SUS_2$, $SUS_3$, and $SUS_4$. In this case, suppose the resistance per unit length of the scanning electrodes $SCN_1$ to $SCN_M$ and the sustain electrodes $SUS_1$ to $SUS_{M+1}$ is R (Ω/m), lengths of the electrodes are L (m), and the center positions of the discharge cells $C_{1j}$, $C_{2j}$, and $C_{3j}$ measured from the left side of the panel are x (m). Further, suppose the sum of discharge currents caused by the respective discharges occurring in two places in respective discharge cells, i.e. the discharges between the respective scanning electrodes and sustain electrodes on both the adjacent sides thereof is I (A), and the center position of the discharge cell $C_{i1}$ at the left end of the panel is expressed as x=0. Further, assuming that $V_{1a}$ and $V_{1b}$, $V_{2a}$ and $V_{2b}$, and $V_{3a}$ and $V_{3b}$ represent the voltages applied to respective discharging places in the discharge cells $C_{1j}$, $C_{2j}$, and $C_{3j}$ when a voltage of 0 and a sustain pulse voltage of −Vm are applied to the scanning electrodes $SCN_1$ to $SCN_M$ and the sustain electrodes $SUS_1$ to $SUS_{M+1}$ respectively, these voltages are described as follows.

In the case shown in FIG. 9(*a*), as is apparent from the diagram, since the discharge currents from the scanning electrodes $SCN_1$ and $SCN_2$ (I/2 each) are added in the sustain electrode $SUS_2$, the quantity of discharge current flowing in the sustain electrode $SUS_2$ is twice the discharge current of I/2. Similarly, the discharge currents from the scanning electrodes $SCN_2$ and $SCN_3$ (I/2 each) are added in the sustain electrode $SUS_3$, and therefore the quantity of discharge current flowing in the sustain electrode $SUS_3$ is twice the discharge current of I/2. Therefore, $V_{1b}=V_{2a}=V_{2b}=V_{3a}=Vm-I\times R\times x-2\times I/2\times R\times(L-x)=Vm-I\times R\times L$. The voltages applied to respective discharging places in the discharge cells $C_{1j}$, $C_{2j}$, and $C_{3j}$ are independent of the positions x of the discharge cells. On the other hand, the discharge current flowing in the respective sustain electrodes $SUS_1$ and $SUS_4$ is only the discharge current of I/2 from the respective scanning electrodes $SCN_1$ and $SCN_3$. Therefore, $V_{1a}=V_{3b}=Vm-I\times R\times x-I/2\times R\times(L-x)=Vm-I\times R\times(L+x)/2$. The voltage applied to one of the two discharging places in each discharge cell is different depending on the position x of the discharge cell. In other words, the discharge intensity varies depending on the positions x of the discharge cells. Thus, the discharges in the two discharging places in the discharge cell $C_{2j}$ always have the same intensity independent of the position x of the discharge cell $C_{2j}$, while with respect to the discharge cells $C_{1j}$ and $C_{3j}$, the discharge intensity in one of the two discharging places in the respective discharge cells $C_{1j}$ and $C_{3j}$ varies depending on their positions x. When the discharge cells $C_{1j}$ and $C_{3j}$ are positioned at the left end of the panel, i.e. j=1, x=0 holds. Therefore, $V_{1a}=V_{3b}=Vm-I\times R\times L/2$. When the discharge cells $C_{1j}$ and $C_{3j}$ are positioned at the right end of the panel, i.e. j=N, x=L holds. Therefore, $V_{1a}=V_{3b}=Vm-I\times R\times L$. Thus, when the discharge cells $C_{1j}$ and $C_{3j}$ are positioned at the right end of the panel, the voltage applied to them is lower than that applied to them when they are positioned at the left end of the panel, and thus the discharge intensity in those discharge cells is decreased.

In the case shown in FIG. 9(*b*), from the same calculation as described above, both of the voltages $V_{2a}$ and $V_{2b}$ applied to the two discharging places in the discharge cell $C_{2j}$ are expressed as $V_{2a}=V_{2b}=Vm-I\times R\times(L+x)/2$. Therefore, the voltage applied to the two discharging places in the discharge cell $C_{2j}$ varies depending on the position x of the discharge cell $C_{2j}$, which means that the discharge intensity varies. In other words, when the discharge cell $C_{2j}$ is positioned at the right end of the panel, the discharge intensity of the discharge cell $C_{2j}$ further decreases compared to that when it is positioned at the left end of the panel.

For simplification, the above description was directed to one discharge cell in the respective first to third rows. In a practical panel, however, the distribution of discharge cells to be operated so as to emit light may be scattered, and in such a discharge intensity varies depending on the positions of the discharge cells. Therefore, in the case of partial display in the panel, the luminance varies on the right and left sides of the panel, thus causing unevenness in display luminance, which has been a problem.

Next, FIGS. 10(*a*), 10(*b*), and 10(*c*) show sectional views taken along line A–A' shown in FIG. 6. These figures illustrate the manner of sustain discharges in a sustain period. These figures show the case where in the sustain period, a sustain pulse voltage is applied to the scanning electrodes $SCN_1$ to $SCN_M$ and the sustain electrodes $SUS_1$ to $SUS_{M+1}$ alternately, and the sustain discharges occur only between the scanning electrode $SCN_2$ and the sustain electrodes $SUS_2$ and $SUS_3$ on both adjacent sides thereof. The solid-line arrows in FIG. 10(*a*) indicate initial sustain discharges in the sustain period that occur between the scanning electrode $SCN_2$ and the sustain electrodes $SUS_2$ and $SUS_3$ on both adjacent sides thereof. Due to these sustain discharges, positive electric charges are stored at the surface of the protective layer 3 on the scanning electrode $SCN_2$, and negative electric charges are stored at the surface of the protective layer 3 on respective half portions of the sustain electrodes $SUS_2$ and $SUS_3$ facing the scanning electrode $SCN_2$. A subsequent sustain pulse voltage is applied to scanning electrodes and sustain electrodes alternately, thus repeating the discharges indicated with the solid-line arrows. In this case, positive electric charges and negative electric charges are stored alternately and reversibly at the surface of the protective film 3 on respective half portions of the sustain electrodes $SUS_2$ and $SUS_3$ facing the scanning electrode $SCN_2$. However, when the sustain discharges continue, the electric discharges stored at the surface of the protective film 3 on respective half portions of the sustain electrodes $SUS_2$ and $SUS_3$ facing the scanning electrode $SCN_2$ spread over the entire surface of the protective film 3 on the sustain electrodes $SUS_2$ and $SUS_3$. Therefore, as shown with broken-line arrows in FIG. 10(*a*), the sustain discharges extend to occur between the scanning electrode $SCN_2$ and the entire surface on the sustain electrodes $SUS_2$ and $SUS_3$. As a result, as shown with the solid-line arrows in FIG. 10(*b*), the sustain discharges also occur between the scanning electrode $SCN_1$ and the sustain electrode $SUS_2$ and between the sustain electrode $SUS_3$ and the scanning electrode $SCN_3$.

Further, when the sustain discharges continue, the discharges that have occurred between the scanning electrode $SCN_1$ and the sustain electrode $SUS_2$ and between the sustain electrode $SUS_3$ and the scanning electrode $SCN_3$ extend to the entire surface on the scanning electrode $SCN_1$ and the entire surface on the scanning electrode $SCN_3$ as shown with the broken-line arrows in FIG. 10(*b*). In this way, the discharges extend successively. As a result, the sustain discharges that should occur only between the scanning electrode $SCN_2$ and the sustain electrodes $SUS_2$ and $SUS_3$ on both adjacent sides thereof extend to occur between all the scanning electrodes $SCN_1$ to $SCN_M$ and all the sustain electrodes $SUS_1$ to $SUS_{M+1}$ as shown in FIG. 10(*c*). In other words, display cells other than those intended to emit light are operated to emit light due to error discharges, thus causing error display, which has been a problem.

The above description was directed only to the sustain discharge in the second row. However, the above-mentioned error discharges also occur in sustain discharges other than those in the second row or in sustain discharges in a plurality of rows.

SUMMARY OF THE INVENTION

The present invention is intended to solve such problems and provides an AC plasma display panel in which display with a uniform luminance over its entire screen can be achieved and the occurrence of error display due to error discharges can be suppressed.

An AC plasma display panel of the present invention includes: a first insulating substrate and a second insulating substrate, which are arranged opposing each other; a scanning/sustain-electrode group including a plurality of sets of a scanning electrode and a sustain electrode that are arranged in parallel to each other on the first insulating substrate; a dielectric layer covering the scanning/sustain-electrode group; and a plurality of data electrodes orthogonal to and opposing the scanning electrode and the sustain electrodes, which are provided on the second insulating substrate. In the AC plasma display panel, discharges between the scanning electrode and the sustain electrode allow phosphors to emit light. Each of the plurality of sets includes, as a unit, the scanning electrode and the sustain electrodes on both sides of the scanning electrode. The plurality of sets are separated from one another.

According to this configuration, it is possible to suppress the extension of sustain discharges in a certain discharge cell to the adjacent discharge cells.

It is preferable that the width of the sustain electrodes is approximately half the width of the scanning electrode. Furthermore, it is preferable that a resistance per unit length of the sustain electrodes is approximately twice as high as that of the scanning electrode.

DETAILED DESCRIPTION OF THE INVENTION

Figure 1:
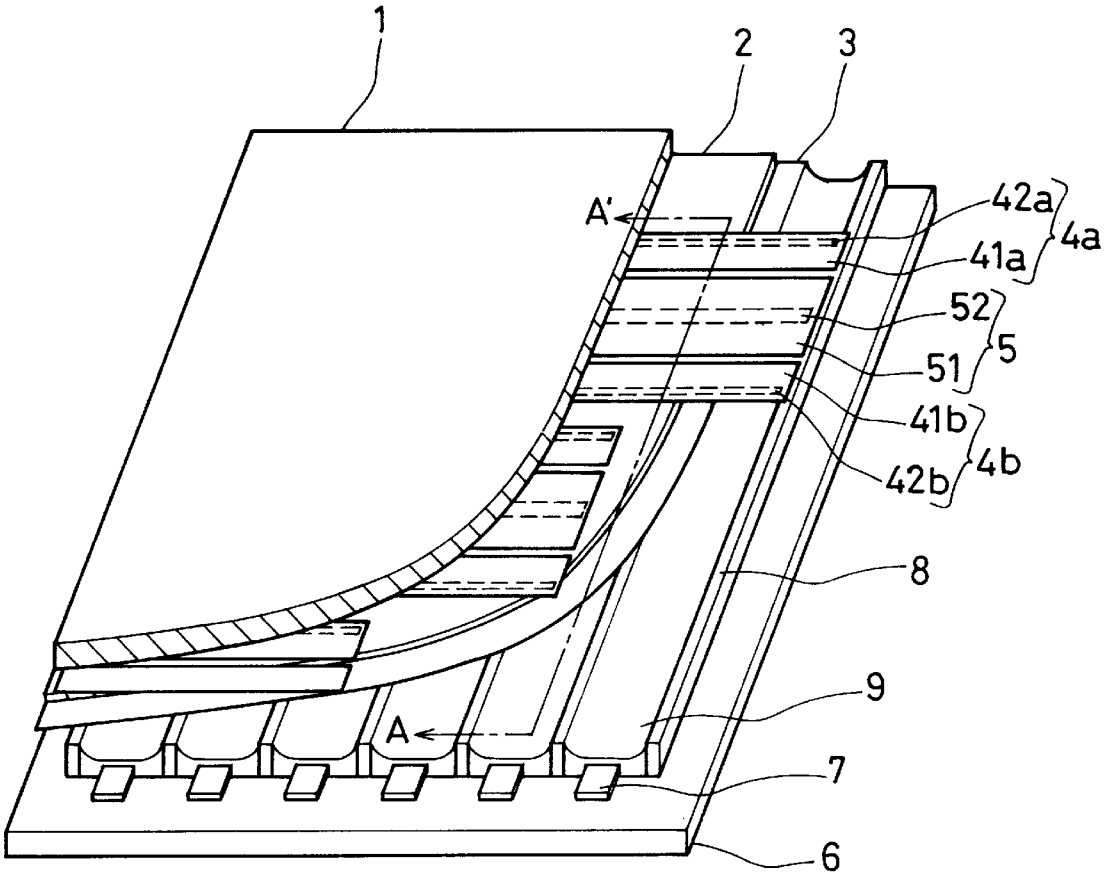
FIG. 1 is a partially cutaway perspective view of a panel according to an embodiment of the present invention.

FIG. 1 shows a partially cutaway perspective view of an AC plasma display panel (hereinafter referred to as a "panel") according to one embodiment of the present invention. As shown in FIG. 1, a plurality of sustain electrodes 4*a* and 4*b* and scanning electrodes 5, which are covered with a dielectric layer 2 and a protective film 3, are provided in parallel on a first insulating substrate 1. A sustain electrode 4*a*, a scanning electrode 5, and a sustain electrode 4*b* are formed sequentially to constitute one set of electrodes and a plurality of such sets are provided in parallel. On a second insulating substrate 6, a plurality of data electrodes 7 are provided. Between the respective data electrodes 7, a plurality of separation walls 8 are provided in parallel to the data electrodes 7. Phosphors 9 are provided on the plurality of data electrodes 7 and side faces of the plurality of separation walls 8. The first insulating substrate 1 and the second insulating substrate 6 are positioned opposing each other so that the sustain electrodes 4*a*, the scanning electrodes 5, and the sustain electrodes 4*b* are orthogonal to the data electrodes 7.

In FIG. 1, each of the sustain electrodes 4*a* includes a transparent electrode 41*a* and a bus-bar 42*a* formed on the transparent electrode 41*a*. Each of the sustain electrodes 4*b* includes a transparent electrode 41*b* and a bus-bar 42*b* formed on the transparent electrode 41*b*. Similarly, each of the scanning electrodes 5 includes a transparent electrode 51 and a bus-bar 52 formed on the transparent electrode 51. A resistance per unit length of the respective sustain electrodes 4*a* and 4*b* is set to be about twice as high as that of the scanning electrodes 5. Generally, a transparent electrode has a high resistance, and therefore a bus-bar formed of silver or the like is superposed on the transparent electrode, thus lowering the resistance in an electrode as a whole. Therefore, the resistances per unit length of the sustain electrodes 4*a* and 4*b* and the scanning electrodes 5 depend on the resistance of the bus-bars. Thus, in the present embodiment, each line width of the bus-bars 42*a* and 42*b* of the sustain electrodes 4*a* and 4*b* is set to be approximately half the line width of the bus-bar 52 of the scanning electrode 52, thus setting the resistance per unit length of the sustain electrodes 4*a* and 4*b* to be approximately twice as high as that of the scanning electrode 5. On both the adjacent sides of every scanning electrode 5, the sustain electrodes 4*a* and 4*b* constituting one set together with the scanning electrode 5 are disposed. Display is carried out by sustain discharges in two places between respective scanning electrodes 5 and the sustain electrodes 4*a* and 4*b* on both the adjacent sides thereof.

Figure 2:
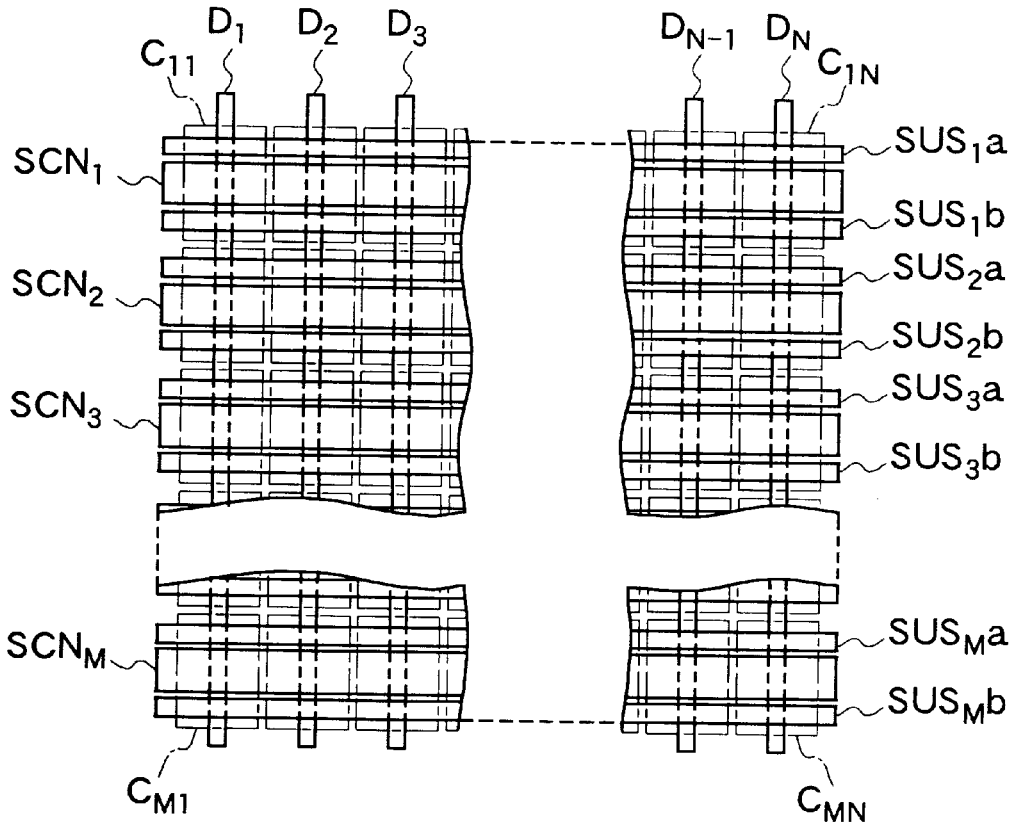
FIG. 2 is a diagram showing an electrode array in the panel according to the embodiment of the present invention.

FIG. 2 is a diagram showing an electrode array in this panel. In the row direction, M rows of sustain electrodes $SUS_{1a}$ to $SUS_{Ma}$, M rows of scanning electrodes $SCN_1$ to $SCN_M$, and M rows of sustain electrodes $SUS_{1b}$ to $SUS_{Mb}$ are arranged. In the column direction, N columns of data electrodes $D_1$ to $D_N$ are arranged. The intersections of the data electrodes and the scanning electrodes and the sustain electrodes on both the adjacent sides thereof function as discharge cells $C_{11}$ to $C_{MN}$ that are arranged in a matrix form of M×N. A set of the scanning electrode and the sustain electrodes on both the adjacent sides thereof is provided corresponding to one discharge cell and is never provided so as to extend over two discharge cells. Two or more of this set of electrodes may be provided in one discharge cell. The scanning electrodes $SCN_1$ to $SCN_M$ are connected to a driving circuit at their left ends and the sustain electrodes $SUS_{1a}$ to $SUS_{Ma}$ and $SUS_{1b}$ to $SUS_{Mb}$ are connected to the driving circuit at their right ends, which is not shown in the figure.

Figure 3:
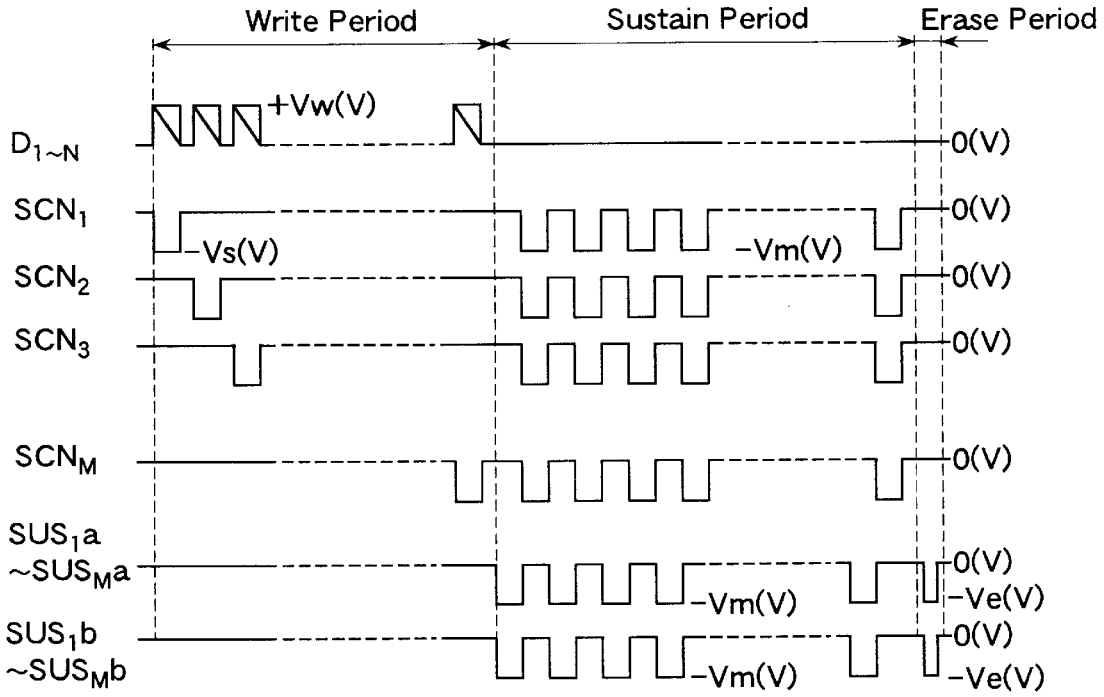
FIG. 3 shows a timing chart of an operation driving waveform illustrating a method of driving the panel according to the embodiment of the present invention.

A method of driving this panel is described using FIG. 3 showing a timing chart of an operation driving waveform.

As shown in FIG. 3, initially, in a write period, all the sustain electrodes $SUS_{1a}$ to $SUS_{Ma}$ and $SUS_{1b}$ to $SUS_{Mb}$ are maintained at a voltage of 0. In scanning of the first row by a scanning electrode $SCN_1$, a positive write pulse voltage of +Vw is applied to a designated data electrode $D_j$ that is selected from the data electrodes $D_1$ to $D_N$ and corresponds to a discharge cell to be operated so as to emit light, and a negative scan pulse voltage of −Vs is applied to the scanning electrode $SCN_1$ in the first row. This causes a write discharge at the intersection of the designated data electrode $D_j$ and, the scanning electrode $SCN_1$. This write discharge induces discharges between the scanning electrode $SCN_1$ and the sustain electrodes $SUS_{1a}$ and $SUS_{1b}$ on both adjacent sides thereof In the discharge cell in which the write discharges have occurred, positive electric charges are stored at the surface of the protective film 3 on the scanning electrode $SCN_1$, and negative electric charges at the surface of the protective film 3 on the sustain electrodes $SUS_{1a}$ and $SUS_{1b}$.

Next, in scanning of the second row by a scanning electrode $SCN_2$, a positive write pulse voltage of +Vw is applied to a designated data electrode $D_j$ that is selected from the data electrodes $D_1$ to $D_N$ and corresponds to a discharge cell to be operated so as to emit light, and a negative scan pulse voltage of −Vs is applied to the scanning electrode $SCN_2$. This causes a write discharge at the intersection of the designated data electrode $D_j$ and the scanning electrode $SCN_2$. This write discharge induces discharges between the scanning electrode $SCN_2$ and sustain electrodes $SUS_{2a}$ and $SUS_{2b}$ on both the adjacent sides thereof. In the discharge cell in which the write discharges have occurred, positive electric charges are stored at the surface of the protective film 3 on the scanning electrode $SCN_2$, and negative electric charges at the surface of the protective film 3 on the sustain electrodes $SUS_{2a}$ and $SUS_{2b}$.

Successively, the same scanning operation is carried out for all remaining rows up to the scanning electrode $SCN_M$ in the M row. Thus, the same predetermined electric charges as described above are stored at the surface of the protective film 3.

In the subsequent sustain period, initially a negative sustain pulse voltage of −Vm is applied to all the sustain electrodes $SUS_{1a}$ to $SUS_{Ma}$ and $SUS_{1b}$ to $SUS_{Mb}$. Thus, in a discharge cell $C_{ij}$ in which the write discharges have occurred, the voltage between a scanning electrode $SCN_i$ and sustain electrodes $SUS_{ia}$ or $SUS_{ib}$ is the sum of the negative sustain pulse voltage of −Vm, the voltage caused by the positive electric charges at the surface of the protective film 3 on the scanning electrode $SCN_i$, and the voltage caused by the negative electric charges at the surface of the protective film 3 on the sustain electrodes $SUS_{ia}$ or $SUS_{ib}$, which exceeds the discharge starting voltage. Therefore, sustain discharges occur between the scanning electrode $SCN_i$ and the sustain electrodes $SUS_{ia}$ and $SUS_{ib}$. As a result, the electric charges stored at the surface of the protective film 3 are reversed and thus negative electric charges are stored at the surface of the protective film 3 on the scanning electrode $SCN_i$ and positive electric charges at the surface of the protective film 3 on the sustain electrodes $SUS_{ia}$ and $SUS_{ib}$.

Successively, the negative sustain pulse voltage of −Vm is applied to all the scanning electrodes $SCN_1$ to $SCN_M$ and all the sustain electrodes $SUS_{1a}$ to $SUS_{Ma}$ and $SUS_{1b}$ to $SUS_{Mb}$ alternately. Thus, in discharge cells $C_{ij}$ in which the write discharges have occurred, sustain discharges occur successively between the scanning electrode $SCN_i$ and the sustain electrodes $SUS_{ia}$ and $SUS_{ib}$. Light emissions caused by those sustain discharges are used for display.

In the subsequent erase period, a negative narrow-width erase pulse voltage of −Ve is applied to all the sustain electrodes $SUS_{1a}$ to $SUS_{Ma}$ and $SUS_{1b}$ to $SUS_{Mb}$. This causes erase discharges to terminate the sustain discharges. With the above-mentioned operations, one picture is displayed in the AC plasma display panel. A driving method in the case of gray-scale display, as in image display in a television, is the same as the conventional method.

In the conventional panel, there have been problems of the difference in luminance on the right and left sides of a screen and the occurrence of light emissions caused by error discharges in discharge cells other than those intended to emit light in the case of partial display. These aspects in the case of the present embodiment are described as follows.

Figure 4:
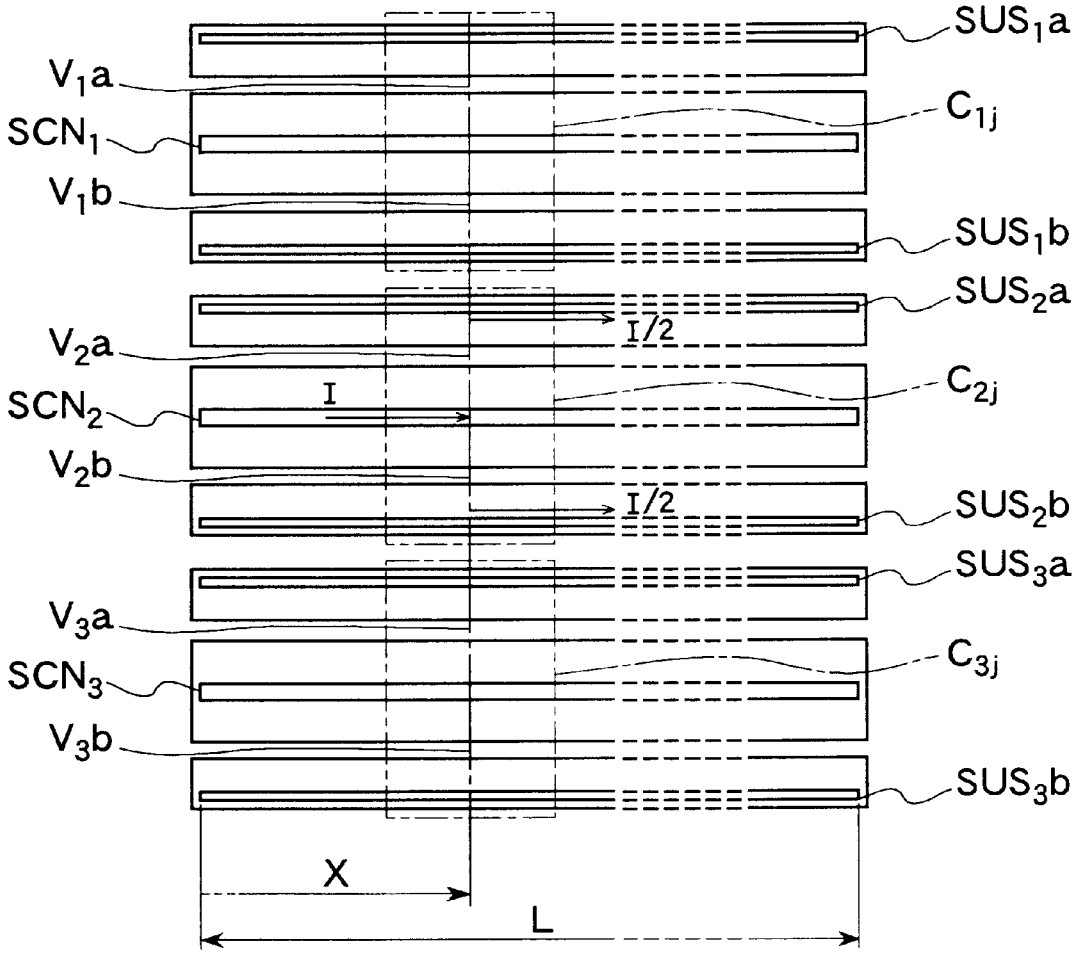
FIG. 4 is a diagram for explaining the discharge intensity in two discharging places in the electrode array in the first to third rows in the electrode array diagram shown in FIG. 2.

FIG. 4 shows an array of the electrodes in the first to third rows shown in the electrode array diagram in FIG. 2. FIG. 4 shows discharge currents flowing in the scanning electrode $SCN_2$ and the sustain electrodes $SUS_{2a}$ and $SUS_{2b}$ when sustain discharges are occurring in one discharge cell $C_{2j}$ positioned in the second row. In this case, suppose the resistance per unit length of the scanning electrodes $SCN_1$–$SCN_M$ is R (Ω/m) and that of the sustain electrodes $SUS_{1a}$ to $SUS_{Ma}$ and $SUS_{1b}$ to $SUS_{Mb}$ is 2×R (Ω/m), the lengths of the electrodes are L (m), and the center position of the discharge cell $C_{2j}$ measured from the left side of the panel is x (m). The center position of the discharge cell $C_{i1}$ at the left end of the panel is expressed as x=0. Further, suppose the sum of discharge currents caused by the respective discharges occurring in two places in the discharge cell $C_{2j}$ (i.e. the discharges between the scanning electrode $SCN_2$ and the sustain electrodes $SUS_{2a}$ and $SUS_{2b}$ on both the adjacent sides thereof) is I (A).

When a voltage of 0 and a sustain pulse voltage of −Vm are applied to the scanning electrodes $SCN_1$–$SCN_M$ and the sustain electrodes $SUS_{1a}$–$SUS_{Ma}$ and $SUS_{1b}$ to $SUS_{Mb}$ respectively, the voltages $V_{2a}$ and $V_{2b}$ applied to the respective discharging places in the discharge cell $C_{2j}$ are expressed as $V_{2a}=V_{2b}=Vm-I\times R\times x-(I/2\times 2)\times R\times(L-x)=Vm-I\times R\times L$. Thus, the voltages applied to the discharging places in the discharge cell $C_{2j}$ are the same independent of the position x of the discharge cell $C_{2j}$. Consequently, almost the same discharge intensity can be obtained independent of the position x of the discharge cell $C_{2j}$.

For simplification, the above description was directed to the voltages applied to the discharging places in one discharge cell in the second row. In a practical panel, however, regardless of how the discharge cells to be operated so as to emit light are distributed, almost the same discharge intensity can be obtained independent of the positions of the discharge cells. Therefore, in partial display, the variation in luminance on a screen can be suppressed.

Figure 5:
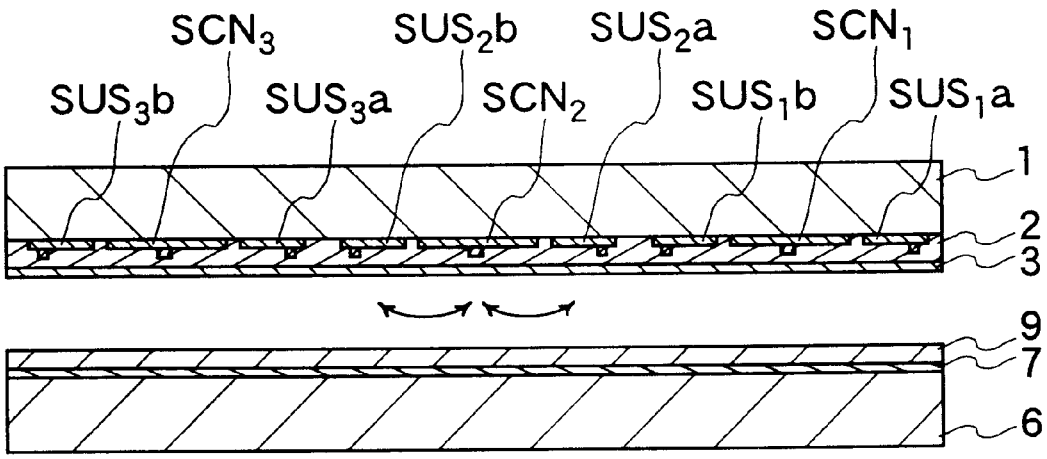
FIG. 5 is a view taken along line A–A' in FIG. 1, illustrating the manner of sustain discharges.
Figure 6:
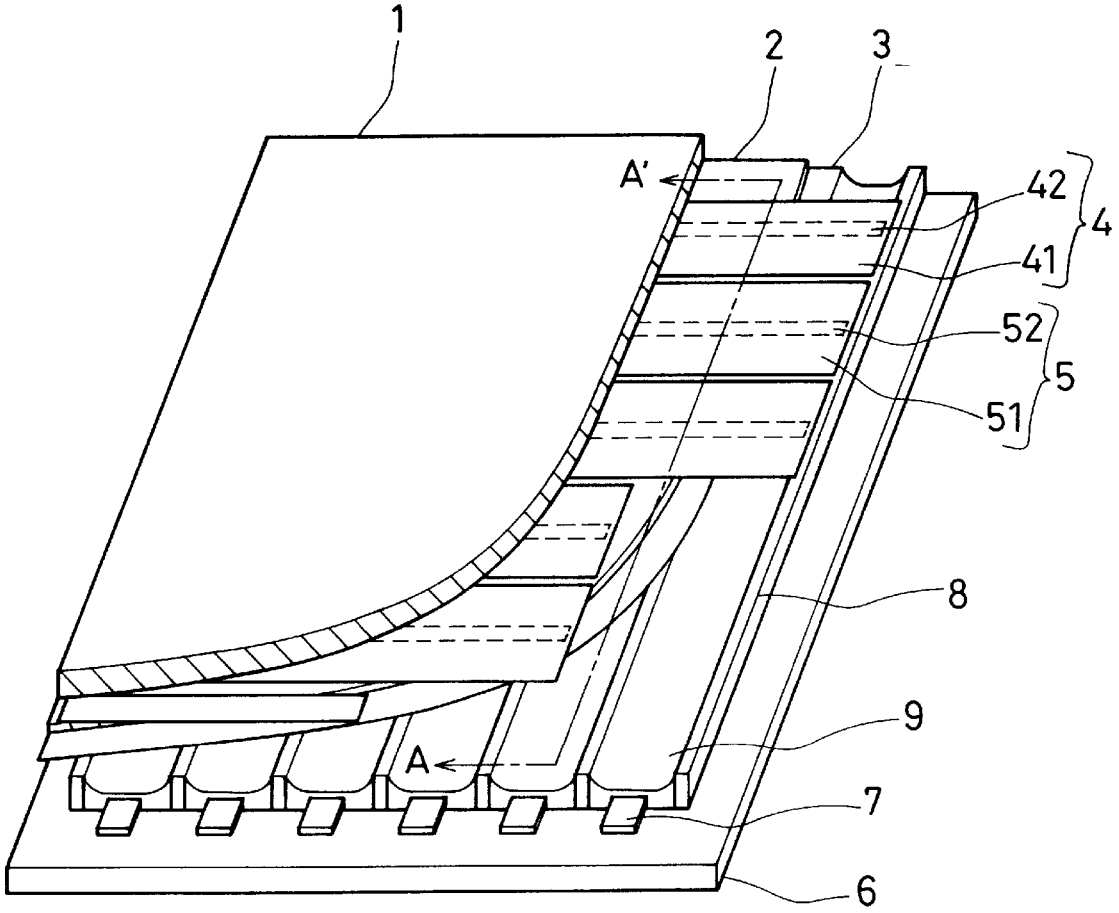
FIG. 6 PRIOR ART
FIG. 6 is a partially cutaway perspective view of a conventional panel.
Figure 7:
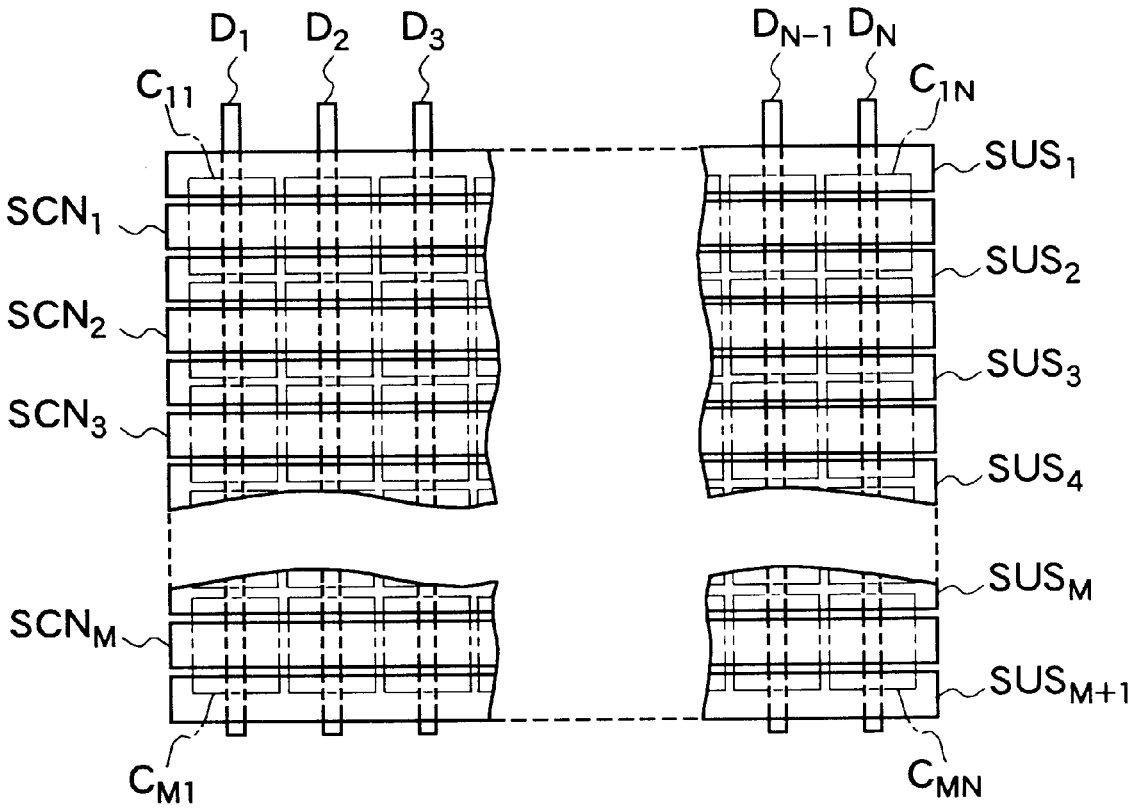
FIG. 7 PRIOR ART
FIG. 7 is a diagram showing an electrode array in the conventional panel.
Figure 8:
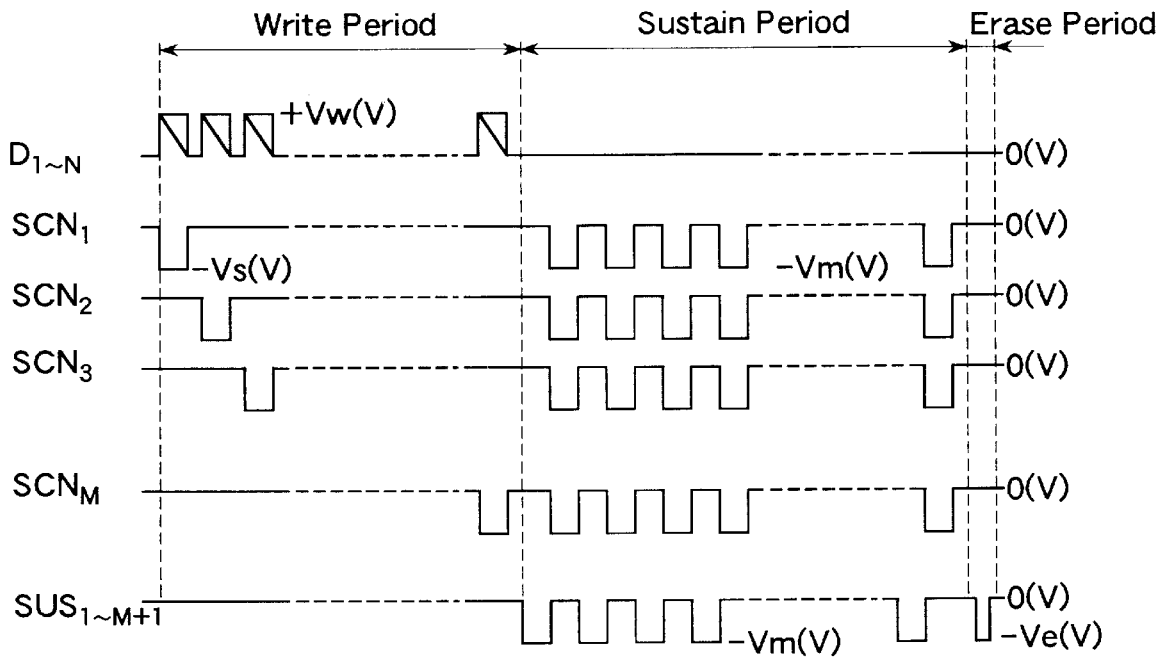
FIG. 8 PRIOR ART
FIG. 8 shows a timing chart of an operation driving waveform illustrating a method of driving the conventional panel.
Figure 9:
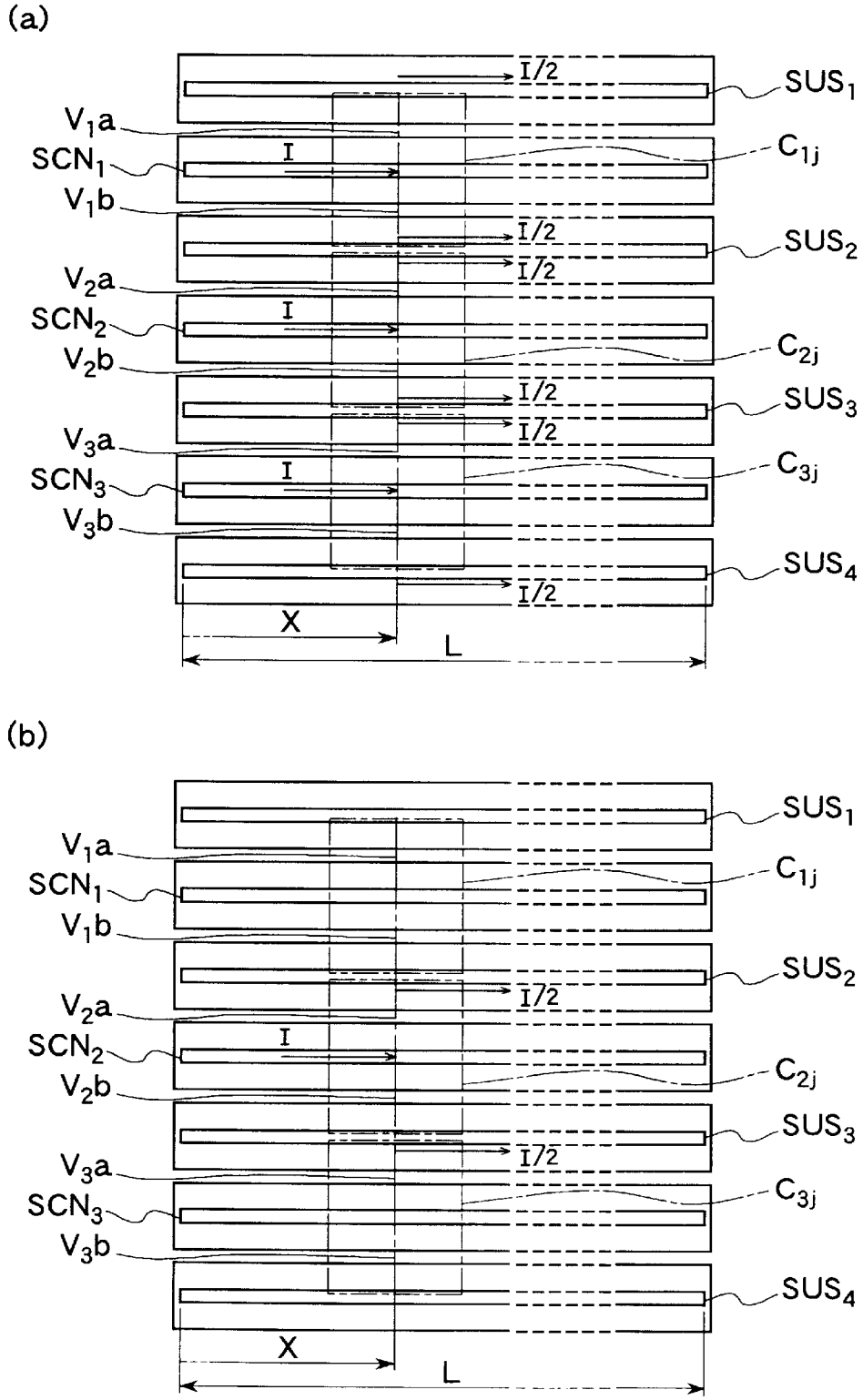
FIG. 9 PRIOR ART
FIG. 9 is a diagram for explaining the discharge intensity in two discharging places in the electrode array in the first to third rows in the electrode array diagram shown in FIG. 7.
Figure 10:
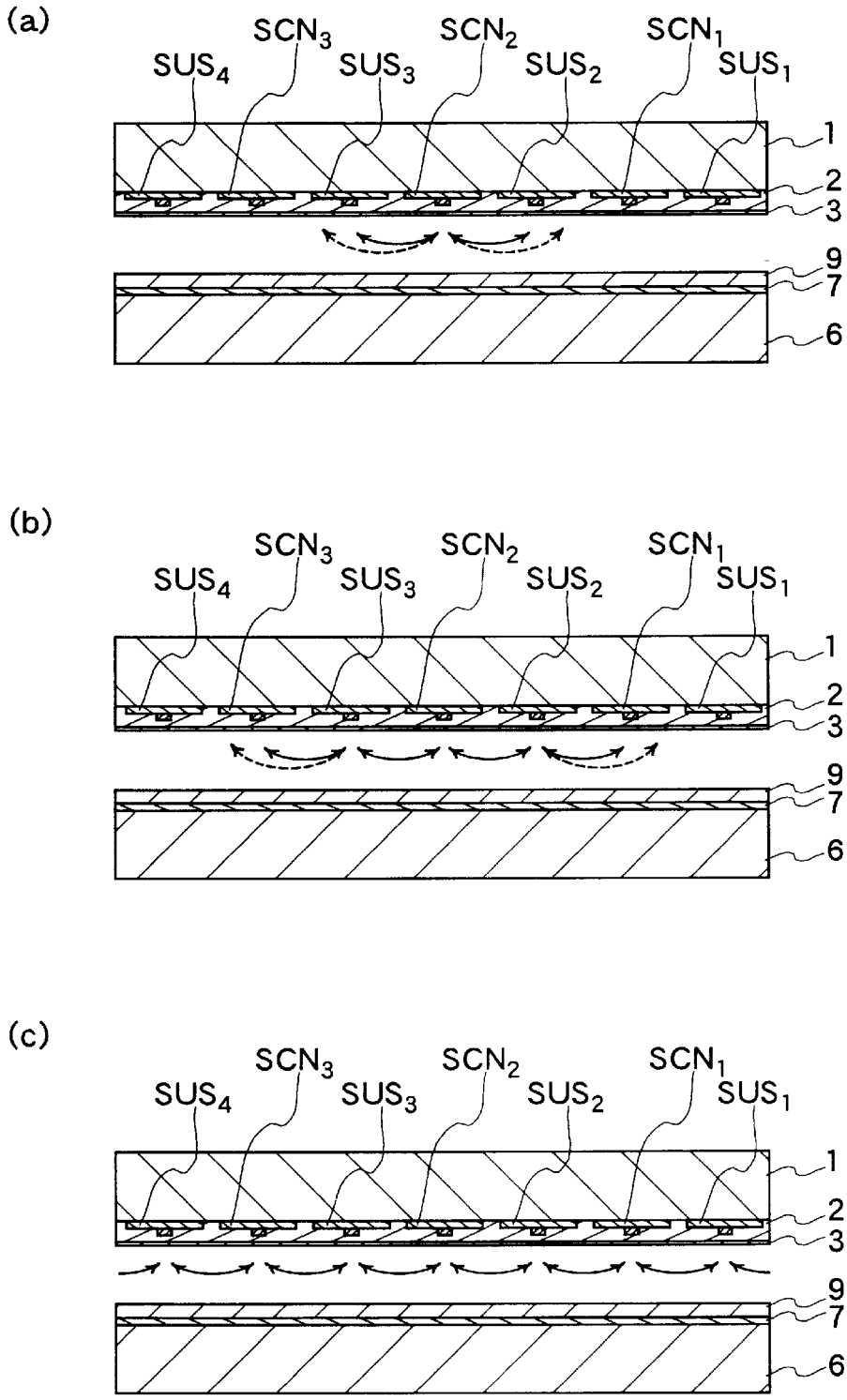
FIG. 10 PRIOR ART
FIG. 10 shows views taken along line A–A' in FIG. 6, illustrating the manner of sustain discharges.

FIG. 5 shows a cross section taken along line A–A' shown in FIG. 1. FIG. 5 illustrates the manner of sustain discharges. In a sustain period, a sustain pulse voltage of −Vm is applied to the scanning electrodes $SCN_1$ to $SCN_M$ and the sustain electrodes $SUS_{1a}$ to $SUS_{Ma}$ and $SUS_{1b}$ to $SUS_{Mb}$ alternately. FIG. 5 shows the case where sustain discharges are allowed to occur only between the scanning electrode $SCN_2$ and the sustain electrodes $SUS_{2a}$ and $SUS_{2b}$ on both the adjacent sides thereof. The solid-line arrows in FIG. 5 indicate initial sustain discharges in the sustain period that occur between the scanning electrode $SCN_2$ and the sustain electrodes $SUS_{2a}$ and $SUS_{2b}$ on both adjacent sides thereof at the beginning of the sustain period. Due to these discharges, positive electric charges are stored at the surface of the protective layer 3 on the scanning electrode $SCN_2$, and negative electric charges are stored at the surface of the protective layer 3 on the sustain electrodes $SUS_{2a}$ and $SUS_{2b}$ on both adjacent sides of the scanning electrode $SCN_2$. Successively, by the alternate application of the sustain pulse voltage, the discharges indicated with the arrows are repeated. Thus, positive electric charges and negative electric charges are stored alternately and reversibly at the surface of the protective film 3 on the sustain electrodes $SUS_{2a}$ and $SUS_{2b}$. In the present embodiment, the sustain electrode $SUS_{1b}$ and the sustain electrode $SUS_{2a}$ are separated, and the sustain electrode $SUS_{2b}$ and the sustain electrode $SUS_{3a}$ also are separated. Therefore, even when the sustain discharges continue, the spread of the positive and negative electric discharges at the surface of the protective film 3 on the sustain electrodes $SUS_{2a}$ and $SUS_{2b}$ over the surface of the protective film 3 on the sustain electrodes $SUS_{1b}$ and $SUS_{3a}$ respectively can be suppressed. Thus, it is possible to suppress light emissions caused by error discharges in display cells other than those intended to be operated so as to emit light.

Preferably, the width of respective transparent electrodes forming the sustain electrodes $SUS_{1a}$ to $SUS_{Ma}$ and $SUS_{1b}$ to $SUS_{Mb}$ is set to be approximately half the width of the respective transparent electrodes forming the scanning electrodes $SCN_1$ to $SCN_M$. This balances the quantity of electric charges stored at the surface of the protective film 3 on the scanning electrode $SCN_2$ and that of electric charges stored at the surface of the protective film 3 on the sustain electrodes $SUS_{2a}$ and $SUS_{2b}$ on both the adjacent sides of the scanning electrode $SCN_2$, thus enabling both the quantities to be almost the same. Therefore, in the above case, even when the sustain discharges continue, positive or negative electric charges stored at the surface of the protective film 3 on the sustain electrodes $SUS_{2a}$ and $SUS_{2b}$ can be stored only at the surface of the protective film 3 on the sustain electrodes $SUS_{2a}$ and $SUS_{2b}$ securely. Consequently, the extension of the sustain discharge to the sustain electrode $SUS_{1b}$ adjacent to the sustain electrode $SUS_{2a}$ is suppressed. Similarly, the extension of the sustain discharge to the sustain electrode $SUS_{3a}$ adjacent to the sustain electrode $SUS_{2b}$ also is suppressed. Thus, the light emissions due to error discharges in display cells other than those intended to emit light can be suppressed further effectively.

The above description was directed to the case where the sustain electrodes and the scanning electrodes are formed of transparent electrodes and bus-bars as one embodiment of the present invention. However, the present invention can be carried out even in panels having other electrode configurations. In addition, the present invention also can be carried out in panels with configurations other than the above-mentioned configuration as one example and in the case using a driving method other than that described above as one example.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An AC plasma display panel, comprising:

a first insulating substrate having a plurality of sets of a scanning electrode and a sustain electrode that are arranged in parallel to each other, the sets of the electrodes being covered by a dielectric layer; and a second insulating substrate having a plurality of data electrodes, the second insulating substrate opposing to the first insulating substrate so that the data electrodes are arranged perpendicular to the sets of the scanning electrode and the sustain electrode, wherein each of the sets of the electrodes on the first insulating substrate includes one scanning electrode and two sustain electrodes disposed respectively on both sides of the scanning electrode, so that each sustain electrode adjoins the other sustain electrode of the neighboring set.

2. The AC plasma display panel according to claim 1, wherein a width of the sustain electrodes is approximately half a width of the scanning electrode.

* * * * *